US010470595B2

(12) United States Patent
Udermann

(10) Patent No.: US 10,470,595 B2
(45) Date of Patent: Nov. 12, 2019

(54) QUICK ASSEMBLY PHOTO FRAME

(71) Applicant: Matthew Udermann, Chaska, MN (US)

(72) Inventor: Matthew Udermann, Chaska, MN (US)

( * ) Notice: Subject to any disclaimer, the term of this patent is extended or adjusted under 35 U.S.C. 154(b) by 0 days.

(21) Appl. No.: 16/162,845

(22) Filed: Oct. 17, 2018

(65) Prior Publication Data

US 2019/0116995 A1 Apr. 25, 2019

Related U.S. Application Data

(60) Provisional application No. 62/576,249, filed on Oct. 24, 2017, provisional application No. 62/576,279, filed on Oct. 24, 2017.

(51) Int. Cl.

| | |
|---|---|
| ***A47G 1/06*** | (2006.01) |
| ***A47G 1/14*** | (2006.01) |
| ***A47G 1/10*** | (2006.01) |
| ***A47G 1/16*** | (2006.01) |
| ***A47G 1/17*** | (2006.01) |
| *G09F 1/12* | (2006.01) |

(52) U.S. Cl.

CPC ..... *A47G 1/0611* (2013.01); *A47G 1/0605* (2013.01); *A47G 1/10* (2013.01); *A47G 1/141* (2013.01); *A47G 1/1666* (2013.01); *A47G 1/17* (2013.01); *A47G 2001/0677* (2013.01); *A47G 2001/0694* (2013.01); *G09F 1/12* (2013.01)

(58) Field of Classification Search

CPC ..... A47G 1/0611; A47G 1/10; A47G 1/16; A47G 1/162; A47G 1/17; G09F 1/12

USPC ..... 40/777, 782, 785

See application file for complete search history.

(56) References Cited

U.S. PATENT DOCUMENTS 3,946,511 A * 3/1976 Wiener, Jr. ..... A47G 1/0611 40/784
4,216,597 A * 8/1980 Kocina ..... A47G 1/0605 248/496
4,275,972 A * 6/1981 Bowen ..... A47G 1/10 40/782
4,301,199 A * 11/1981 Pfanstiehl ..... A47G 1/06 40/594

(Continued)

OTHER PUBLICATIONS https://www.amazon.com/SnapeZo-Aluminum-Front-Loading-Mounting-Professional/dp/B007OJNORQ/ref=sr_1_1_sspa?ie=UTF8&qid=1540400952&sr=8-1-spons&keywords=snap+frame&psc=1, printed Oct. 29, 2018.

*Primary Examiner* — Gary C Hoge
(74) *Attorney, Agent, or Firm* — Vidas, Arrett & Steinkraus, P.A.

(57) ABSTRACT

The invention relates to a frame which may be easily assembled and includes a plurality of frame members in an unassembled state. Each of the frame members has a back, a first side having a first angle, and a second side having a second angle. The first angle and the second angle are supplementary angles. The frame also includes a plurality of adhesive portions and/or connectors which are attached to the back of the frame members. The opposite surface of the adhesive portions include a re-attachable adhesive enabling individual frame members to be pressed onto a wall surface to form the frame. An item is disposed between the back of the frame members and the wall surface. The frame members may be independently removed from the wall surface for repositioning, or the frame as a whole may be removed for repositioning on the wall surface.

14 Claims, 6 Drawing Sheets

(56) References Cited

U.S. PATENT DOCUMENTS

| | | | | | |
|---|---|---|---|---|---|
| 4,450,637 | A | | 5/1984 | Russ | |
| 4,493,583 | A | * | 1/1985 | Wallace | A47G 1/10 403/295 |
| 4,738,039 | A | * | 4/1988 | Sun | A47G 1/10 40/784 |
| 4,862,612 | A | | 9/1989 | Sugihara et al. | |
| 4,913,579 | A | * | 4/1990 | Campana | A47B 96/201 403/294 |
| 5,031,874 | A | * | 7/1991 | Shannon | A47G 1/17 248/683 |
| 5,090,835 | A | * | 2/1992 | Cox | A47G 1/10 403/294 |
| 5,253,439 | A | | 10/1993 | Shanok et al. | |
| 5,359,794 | A | | 11/1994 | Wood | |
| 5,364,671 | A | * | 11/1994 | Gustafson | A47G 1/06 40/797 |
| 5,380,119 | A | * | 1/1995 | Hadden | A47G 1/10 144/353 |
| 6,189,252 | B1 | * | 2/2001 | Dowzall | A47G 1/10 40/783 |
| 6,216,378 | B1 | | 4/2001 | Roberto | |
| 6,282,828 | B1 | | 9/2001 | Cecchetto | |
| 6,427,371 | B2 | | 8/2002 | Olson et al. | |
| 6,553,704 | B1 | | 4/2003 | Pigg | |
| 6,826,863 | B1 | | 12/2004 | Goodfellow | |
| 6,898,886 | B1 | * | 5/2005 | Montecalvo | A47G 1/0616 40/740 |
| D677,907 | S | | 3/2013 | Hand | |
| 9,642,428 | B2 | | 5/2017 | Brown et al. | |
| 9,648,967 | B2 | | 5/2017 | Scheyer et al. | |
| 9,706,861 | B2 | | 7/2017 | Wang | |
| 2005/0102879 | A1 | * | 5/2005 | Houssian | A47G 1/10 40/785 |
| 2006/0113454 | A1 | * | 6/2006 | Douglas | A47G 1/162 248/477 |
| 2006/0236576 | A1 | * | 10/2006 | Wear | A47G 1/0611 40/607.14 |
| 2008/0283705 | A1 | * | 11/2008 | Morrison | A47G 1/06 248/304 |
| 2014/0047747 | A1 | | 2/2014 | Jackson | |
| 2017/0009792 | A1 | * | 1/2017 | Ou | A47G 1/06 |
| 2018/0199736 | A1 | * | 7/2018 | Spiro | A47G 1/0605 |
| 2019/0053644 | A1 | * | 2/2019 | Barnes | A47G 1/06 |

* cited by examiner

QUICK ASSEMBLY PHOTO FRAME

CROSS-REFERENCE TO RELATED APPLICATIONS

This application claims the benefit of U.S. Provisional Patent Application Ser. No. 62/576,249 filed Oct. 24, 2017 and this application claims the benefit of U.S. Provisional Patent Application Ser. No. 62/576,279 filed Oct. 24, 2017, which are incorporated by reference herein in their entirety.

FIELD OF THE INVENTION

The present invention in general relates to frames for items such as photographs, artwork, certificates, memorabilia, t-shirts and posters and other items, which an individual desires to include within a frame for attaching to a vertical surface or to freely stand upon a horizontal surface.

BACKGROUND OF THE INVENTION

Individuals engaged in artistic activities, photographers, do it yourselfers performing home improvement activities, interior decorators, as well as individuals desiring to display acclimations (certificates, awards), as well as individuals capturing memories, use numerous types, sizes and styles of frames. The variation in design of known frames is extensive. Frequently the known frames include a decorative or protective plastic or glass pane. The known frames are also pre-assembled, and may include some form of mat and backing material.

These frames are provided in various sizes and take up significant storage, display and shipping space.

Alternatively, individuals often seek custom framing to exact and various sizes from an array of molding and decorative options. The dimensions, colors, materials of both of the frame and mat material have been selected by a framer or an item owner, where the frame and mat for an item have been handmade for display in specific style of environment.

In the past frames have not been available which have been made of premium materials such as wood, where the frames have been stored, shipped or displayed for purchase in a compact unassembled configuration. Individuals have not been afforded the opportunity to quickly and easily assemble a frame formed of superior materials having strong aesthetic qualities with no tools or mess. Individuals have not been able to quickly hang framed items without putting a hole in the wall. Traditional photograph frames require use of nails and installation tools, often resulting in "drift" whereby the installed frame becomes un-level, sometime after installation.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. § 1.56(a) exists.

All U.S. patents and applications and all other published documents mentioned anywhere in this application are incorporated herein by reference in their entirety.

Without limiting the scope of the invention, a brief description of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided for the purposes of complying with 37 C.F.R. § 1.72.

GENERAL DESCRIPTION OF THE INVENTION

In some embodiments the invention is directed to frames which are dissembled, ultra-compact, using minimal storage space prior to sale, which saves retailers and framers display and merchandise space as well as overhead expenses providing to framers and retailers the opportunity to pass cost savings to end users/customers.

In some embodiments the invention may easily be added to the purchase of an item to be displayed, eliminating the need for costly packaging and shipping expense associated with traditional frames. Frequently the invention enables an item such as art, a print, or a poster to be rolled and placed within a tube or like container including the frame with no minimal incremental shipping cost and no or minimal increased packaging materials and associated costs.

In some embodiments, the invention may be shipped minimizing breakage as compared to shipment of assembled frames. Shipping of assembled frames traditional has an industry breakage range up to 8%.

In some embodiments, the invention maximizes the utility to an individual while minimizing cost for a consumer while simultaneously functioning for the intended purpose without fracture or fail as compared to the assembly, shipping and use of traditionally available frames.

In some embodiments, the invention eliminates the need for installation mounting tools, hardware and/or associated wall holes enabling a user to quickly assemble the frame system in a fraction of the time an individual needs to install/hang/mount a traditional frame, and without the mess of a penetrating hangar (nail, screw etc.) or the waste of excess packaging.

In at least one embodiment a frame for an item has at least two elongated frame members (or circular application) requiring connectors, each of the frame members having a first unassembled state, each of the frame members having a front, a back, a first edge, the first edges having an identical first length dimension, a second edge, the second edges having an identical second length dimension, each of the first edges being substantially parallel to the second edges. The most common embodiment includes four elongated frame members. The most common elongated frame members being configured to allow two of the frame members to nest compactly with one another for the purpose of storage and shipping.

In at least one embodiment each of the frame members has a first side and a second side, the first side having a first angle relative to the first edge and the second edge, the second side having a second angle relative to the first edge and the second edge, wherein the first angle and the second angle are supplementary angles.

In some embodiments the frame includes a plurality of adhesive portions or adhesive strips, each of the adhesive portions or adhesive strips having a first unengaged state, each of the adhesive strips having a first surface and an opposite surface, an attachment adhesive on the first surface, a first removable film on the attachment adhesive, a re-attachable adhesive on the opposite surface, and a second removable film on the re-attachable adhesive. The removable film allows exposure of the respective adhesive for either attachment to the frame or to apply to a surface for hanging. The re-attachable adhesive may be re-positionable and wall safe. The adhesive may also have a thickness, which permits adhesion on a less than flat surface.

In some embodiments, the first removable film is constructed and arranged for separation from the attachment adhesive of at least one of the adhesive portions or adhesive strips whereupon the at least one adhesive portion or adhesive strip is constructed and arranged for secure attachment of the first surface to the back of each of the frame members.

In some embodiments the second removable film is constructed and arranged for removal from the re-attachable adhesive of at least one of the adhesive portion or adhesive strips on each of the frame members and the at least one opposite surface is constructed and arranged for pressing onto a wall surface.

In some embodiments the back, the first side and the first angle of one of the frame members is disposed adjacent to and in contact with the back, the second side and the second angle of another of the frame members on the wall surface in a second assembled state forming the frame.

In at least one embodiment an item is disposed between the back and the wall surface, wherein each of the frame members is independently removable from the wall surface, or the frame as a whole in the second assembled state may be removed from the wall surface, and the frame members or the frame are repositioned to another location relative to the wall surface.

In at least one embodiment each of the backs of the frame members comprise at least one marking, the at least one marking being constructed and arranged for alignment of the item relative to the frame.

In at least one embodiment a frame has at least two frame members, each of the frame members having a first unassembled state, each of the frame members having a front, a back, a first edge, the first edges having an identical first length dimension, a second edge, the second edges having an identical second length dimension, the second length dimension being less than the first length dimension, each of the first edges being substantially parallel to the second edges, each of the frame members further having a first side and a second side, the first side having a first angle relative to the first edge and the second edge, the second side having a second angle relative to the first edge and the second edge, wherein the first angle and the second angle are supplementary angles.

In some embodiments the back, the first side and the first angle of one of the frame members is disposed adjacent to and in contact with the back, the second side and the second angle of another of the frame members in a second assembled state, forming the frame.

In at least one embodiment, each of the first sides and each of the second sides have a cavity, wherein alignment of the cavities of the first sides to the cavities of the second sides forms a shaped cavity, the shaped cavity defining an outer cavity wall.

In at least one embodiment a shaped connector is disposed in each of the shaped cavities, each of the shaped connectors comprise an expandable first end having at least one first opening and an expandable second end having at least one second opening, each of the shaped connectors having an exterior surface.

In at least one embodiment a connector insert is placed into each of the shaped connectors, the connector insert comprises expansion posts, wherein the expansion posts are constructed and arranged for insertion into the at least one first opening and the at least one second opening expanding the exterior surface into contact with the outer cavity wall.

In at least one embodiment the backs of each of the frame members has at least one elongate cavity.

In at least one embodiment the frame further comprises a plurality of cavity connectors, wherein one of the cavity connectors is disposed in each of the elongate cavities.

In at least one embodiment, each of the shaped connectors further comprises an expansion cavity proximate to the at least one first opening and the at least one second opening.

In at least one embodiment each of the connector inserts further comprises at least one extension having a distal end having a tab, the at least one extension and the tab being constructed and arranged to engage and to hold an item proximate to the back of the frame members in the second assembled state.

In at least one embodiment, each of the cavity connectors comprise a base having at least one aperture and at least one cross tab.

In at least one embodiment the cross tab engages the item, holding the item proximate to the back of the frame members in the second assembled state.

In at least one embodiment one of the apertures on one of the cavity connectors on one of the frame members and one of the apertures on one of the cavity connectors on one of the opposite frame members is constructed and arranged to receive a suspension member, the suspension member being engaged to the wall surface and hanging the frame from the wall surface.

In at least one embodiment, the base of each of the cavity connectors has a friction fitting, wherein one or a series of friction contacts releasably engage one of the elongate cavities.

In at least one embodiment the frame further comprises a plurality of adhesive portions or adhesive strips, each of the adhesive portions or adhesive strips having a first unengaged state, each of the adhesive portions or adhesive strips having a first surface and an opposite surface, the first surface having an attachment adhesive and a first removable film on the attachment adhesive, the opposite surface having a re-attachable adhesive and a second removable film on the re-attachable adhesive.

In at least one embodiment the first removable film is constructed and arranged for separation from the attachment adhesive of at least one of the adhesive portions or adhesive strips and the at least one adhesive portion or adhesive strip is constructed and arranged for secure attachment of the first surface to the back of each of the frame members.

In at least one embodiment the second removable film is constructed and arranged for removal from the re-attachable adhesive on each of the frame members, and the opposite surface is constructed and arranged for pressing onto a wall surface.

In at least one embodiment an item is disposed between the frame and the wall surface, and each of the frame members may be independently removed from the wall surface, or the frame as a whole in the second assembled state is removed from the wall surface, and the frame members or the frame may be repositioned onto the wall surface at a different location.

In at least one embodiment, a stiff backer may be added to the frame members to provide structure for the provision of a vertically positioned assembled frame and/or a vertical freestanding display.

In at least one embodiment, the stiff backer may be scored or cut to allow the backer to be stored in an accordion-type fashion, whereupon the backer may regain stiffness properties when flattened and/or connected to the frame members or to an item.

In at least one embodiment, the stiff backer may have a pop-out easel to extend from the flat position to allow the frame to lean on a surface and allow for a freestanding display.

In at least one embodiment, the stiff backer may have adhesive on at least one side and may be adhered to a print/art/image/item to provide a display with or without the use of a frame, and with or without the backer being folded into an accordion-type configuration, and where the backer may be mailed through traditional mailing/shipping methods.

In at least one embodiment, the cavities and connector system may be applied to molding and achieve a multi-elongated frame member connection, using stock materials and/or molding as available or as custom made.

In at least one embodiment each of the backs of the frame members comprise at least one marking, the at least one marking being constructed and arranged for alignment of the item relative to the frame.

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

DETAILED DESCRIPTION OF THE PREFERRED EMBODIMENTS

The quick assembly picture frame is in general referred to by the numeral 10. The quick assembly picture frame 10 is preferably formed of four frame members 12, 14, 16 and 18, which are obtained by a user in an unassembled configuration and may be assembled into a rectangular or other shape of frame 10. It should be noted that any number of frame members may be used to form the frame 10 and that the frame 10 is not restricted to being rectangular in shape, and may have the shape of a triangle, hexagon, pentagon or octagon to name a few of the many possible shapes for the frame 10. The frame 10 in some alternative embodiments may also be oval or circular in shape or may take on other unique shapes, one example of which may be the shape of a T-Shirt outline. It should be noted that the shapes identified herein are not restrictive to the almost infinite variety of shapes, which may be used for the frame 10.

Figure 1:
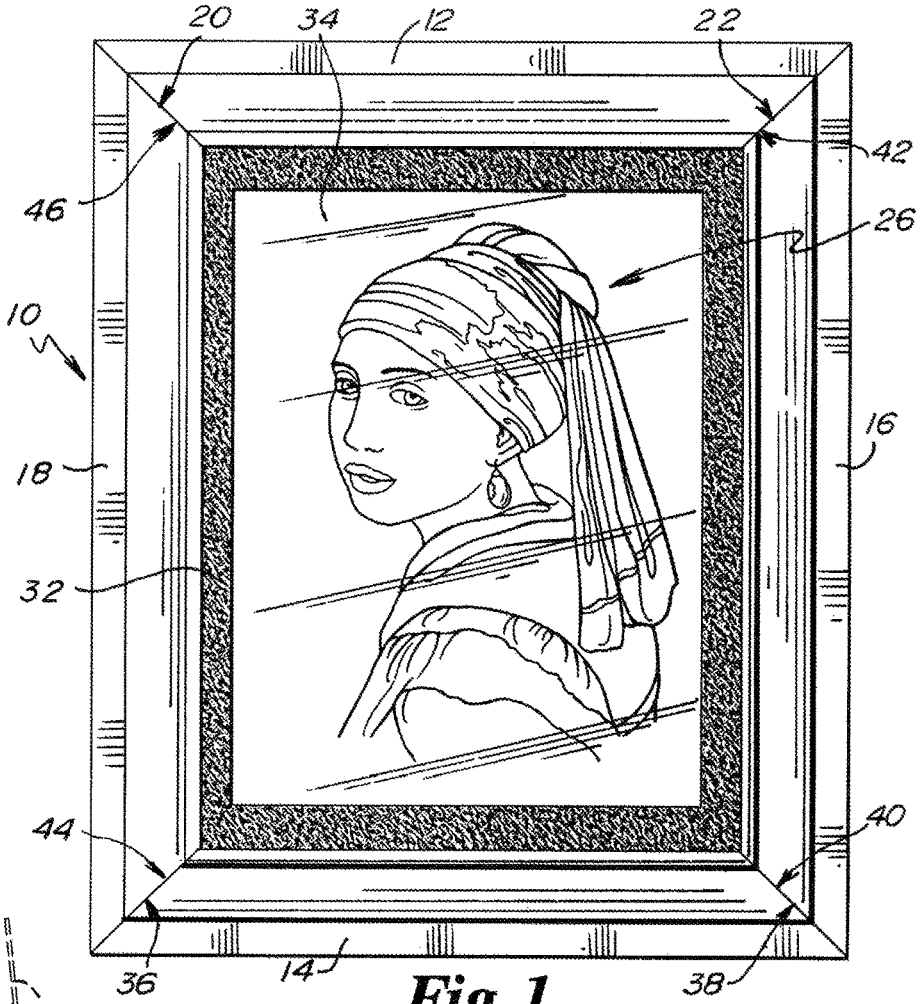
FIG. 1 is an environmental view of one embodiment of the front of the assembled frame.
Figure 2:
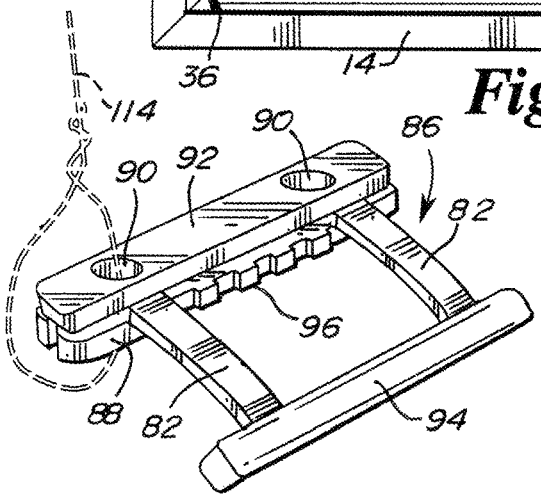
FIG. 2 is an isometric view of one embodiment of a cavity connector used in one embodiment of the invention.
Figure 3:
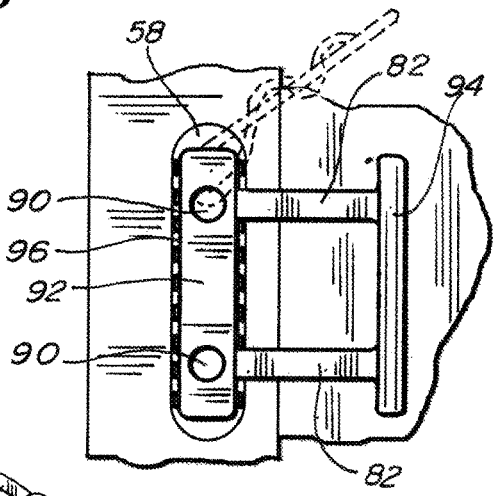
FIG. 3 is a top detail perspective view of one embodiment of the cavity connector disposed in an elongate cavity of one embodiment of the invention and showing an alternative position of the cavity connector in phantom line.
Figure 4:
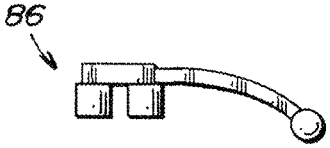
FIG. 4 is a detail side view of one embodiment of the cavity connector used in one embodiment of the invention.
Figure 5:
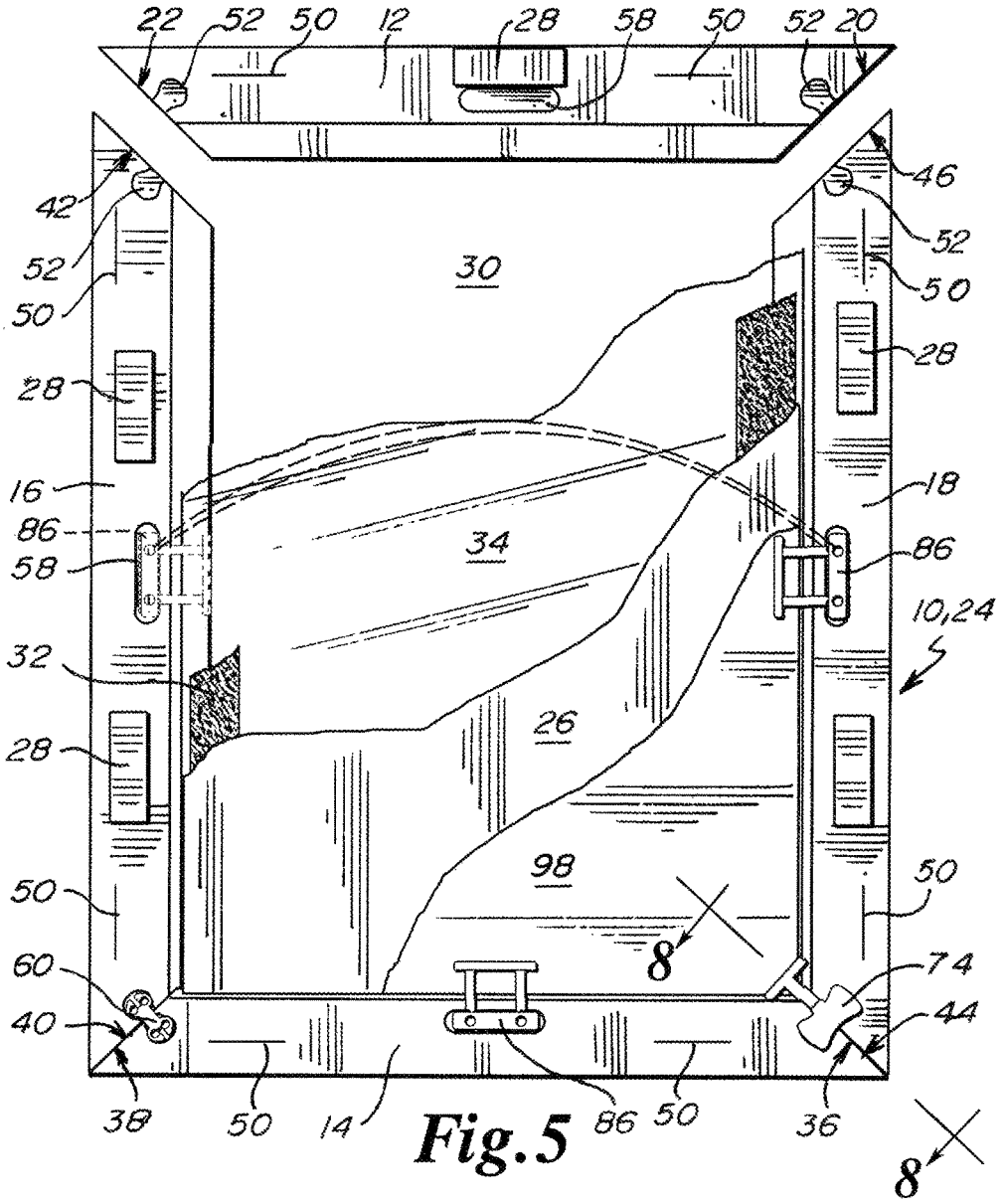
FIG. 5 is a rear environmental view of one embodiment of a partially assembled frame.

As may be seen in FIG. 5, throughout this description, as viewed from the back, frame member 12 will generally be designated as the top frame member, frame member 14 as the bottom frame member, frame member 16 as the left frame member and frame member 18 as the right frame member. An individual, depending on the circumstances, may rotate the frame 10 so that frame member 12 is at the bottom or the sides of the frame 10.

Frame members 12, 14, 16 and 18 preferably include a front and a back 24. The front will include the visible exterior surface observable to an individual when viewing the frame 10 and item 26. In some alternative embodiments, the frame member 12 may have any length and width dimensions as desired. In some embodiments, the width of frame member 12 may be between ½ inch and up to or exceeding 5 inches at the discretion of an individual. In at least one embodiment, the frame member 12 will have a length dimension of between 3 inches and up to or exceeding 3 feet at the discretion of an individual.

Figure 10:
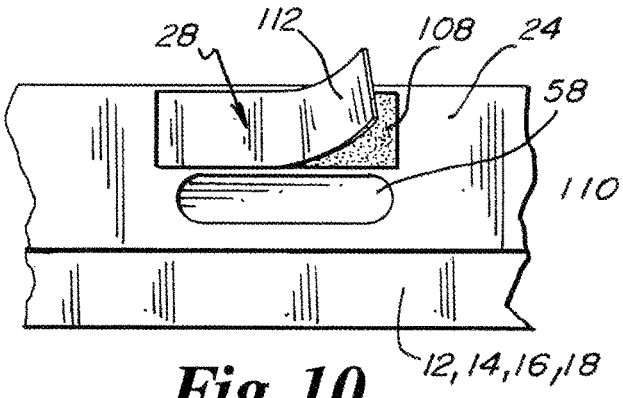
FIG. 10 is a detail partial isometric view of a frame member having an elongate cavity and adhesive portion or adhesive strip affixed to the back of the frame member as used in one embodiment of the invention.
Figure 11:
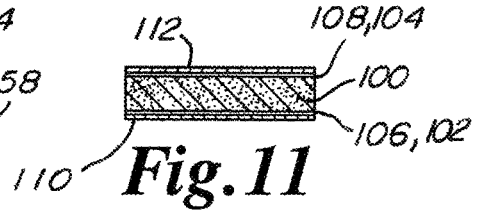
FIG. 11 is a detail cross-sectional side view of an adhesive portion or an adhesive strip as used in one embodiment of the invention.

Referring to FIG. 5, FIG. 10 and FIG. 11 in at least one alternative embodiment, the back 24 of frame member 12 includes an adhesive portion or an adhesive strip 28. A first surface 102 of adhesive portion or adhesive strip 28 is preferably protected by a first removable film 110. Upon the removal of the first protective film 110 the adhesive portion or the adhesive strip 28 may be placed directly onto the back 24 of the frame members 12. In some embodiments, the opposite surface 104 of the adhesive portion or adhesive strip 28 includes a second removable film 112, which may be separated from the adhesive portion or adhesive strip 28. The opposite surface 104 of the adhesive portion or the adhesive strip 28 may then be placed into contact with a vertical or other surface, attaching frame member 12 to for example a wall 30.

In some alternative embodiments the attachment of frame 10 to a wall 30 may begin by the engagement of the first surface 102 of the adhesive portion or the adhesive strip 28 to the back 24 of the frame member 12, 14, 16, and 18 and then the engagement of the opposite surface 104 of the adhesive portion or the adhesive strip 28 to a wall 30. The opposite surface 104 of the adhesive portion or adhesive strip 28 is preferably removable and re-attachable to a wall 30 on a plurality of occasions at the same or at a different location. The opposite surface 104 of the adhesive portion or the adhesive strip 28 provides to a user a plurality of separations and re-attachments permitting the frame 10 to be moved to another location or position relative to a wall 30. The adhesive on the opposite side of the adhesive portion or the adhesive strip 28 preferably does not leave a residue on a wall 30 or other surface if a frame member or frame 10 is repositioned.

In some alternative embodiments, the first surface 102 of the adhesive portion or the adhesive strip 28 is permanently engaged to the back 24 of frame member 12 following the removal of the first removable film 110 and the contact between the attachment adhesive 106 and the back 24 of frame member 12. Adhesive portions or adhesive strips 28 may also be attached to the back 24 of frame members 14, 16 and 18 as described relative to frame member 12. The opposite surface 104 of adhesive portion or adhesive strips 28 as attached to frame members 14, 16 and/or 18 will function as described above relative to frame member 12.

In some alternative embodiments, the adhesive portion or the adhesive strip 28 has dimensions of approximately 2 inches in length and ½ inch in width. In other embodiments, the adhesive portion or the adhesive strips 28 have larger or smaller length and width dimensions dependent upon the size of frame member 12 and frame 10. In some embodiments, at least one adhesive portion or adhesive strip 28 is attached to the back 24 of frame member 12 for each four-inch length dimension. For example, a frame member 12 having a length dimension of between eight inches and twelve inches will include at least two adhesive portions or adhesive strips 28, and may include more adhesive portions or adhesive strips 28 at the preference of an individual. Another adhesive portion or adhesive strip 28 may be positioned next, and parallel to each other, when a frame 10 has an increased width dimension. Alternatively, two adhesive portions or adhesive strips 28 may be offset and parallel to each other when a frame 10 has an increased width dimension.

In some alternative embodiments, frame members 12, 14, 16 and/or 18 may be formed of wood, premium wood, veneer wood, plastic, cardboard, cellular PVC, PVC, metal and other materials and composites of the identified and other materials. The front of frame members 12, 14, 16 and/or 18 may be painted, stained, routed, provided with decorative images, etchings, openings or markings or formed into any desired contoured shape, in order to provide an aesthetic appearance for a frame 10 as desired by an individual. Custom or stock molded framing material may also be used, and the framing system elements may be applied to achieve the ultra-compact frame and connector system solution.

In some alternative embodiments, the adhesive used in the adhesive portions or the adhesive strips 28 has sufficient strength to attach and to hold the weight of the frame 10, mat 32, glass or polymer pane 34, backing 98 and image 26 upon a wall 30, without separation or failure with respect thereto. In addition, in some embodiments, adhesive portions or the adhesive strips 28 have sufficient heat or cold tolerance to attach and to hold the weight of the frame 10, mat 32, glass or polymer pane 34, backing 98 and image 26 upon a wall 30 within a temperature range of 20° F. to 180° F., where the humidity level is equal to, or less than 85%.

Referring to FIG. 5, in at least one alternative embodiment, frame member 12 has a first side 20, which includes an angle of 45° when the shortest edge of the frame member 12 is disposed towards the bottom. In this orientation frame member 12 has a second side 22, which includes an angle of 135°. In some embodiments, frame member 14 includes a third side 36 and forth side 38. Frame member 16 includes a fifth side 40 and a sixth side 42 and frame member 18 includes seventh side 44 and eighth side 46. The pairs of angles on each frame member 12, 14, 16 and 18 are supplementary angles.

As may be seen in FIG. 5, during assembly of frame 10, first side 20 is disposed proximate to and in contact with eighth side 46, second side 22 is disposed proximate to and in contact with sixth side 42, third side 36 is disposed proximate to and in contact with seventh side 44 and fourth side 38 is disposed proximate to and in contact with fifth side 40.

As described herein, first side 20 has an angle of 45° between the longer edge and shorter edge of frame member 12. Eighth side 46 has an angle of 135° between longer edge and shorter edge of frame member 18. First side 20 and eighth side 46 when disposed in contact with each other form a 90° corner angle between frame member 12 and frame member 18.

Second side 22 has an angle of 135° between longer edge and shorter edge of frame members 12. Sixth side 42 has an angle of 45° between longer edge and shorter edge of frame member 16. Second side 22 and sixth side 42 when disposed in contact with each other form a 90° corner angle between frame members 12 and rail 16.

Third side 36 has an angle of 135° between longer edge and shorter edge of frame member 14. Seventh side 44 has an angle of 45° between longer edge and shorter edge of frame members 18. Third side 36 and seventh side 44 when disposed in contact with each other form a 90° corner angle between frame members 14 and rail 18.

Fourth side 38 has an angle of 45° between longer edge and shorter edge of frame member 14. Fifth side 40 has an angle of 135° between longer edge and shorter edge of frame members 16. Fourth side 38 and fifth side 40 when disposed in contact with each other form a 90° corner angle between frame members 14 and rail 16.

It should be noted that the angle selected for the corners between adjacent sides of frame members 12, 14, 16 and 18 is not required to be a standard angle of 90°. For example, if frame 10 is to be provided in the shape of a pentagon, then five frame members would be required and the angle between adjacent sides within an internal corner would be 108°. In some embodiments, four, five, six, seven or eight or more frame members may be combined together to form frame 10.

In some alternative embodiments, the back 24 of frame members 12, 14, 16 and/or 18 may include one or more adhesive portions or supplemental item attachments. Item attachments may include protective film as earlier described relative to the adhesive portions or the adhesive strips 28. The first surface of item attachments may be secured to the back 24 of frame members 12, 14, 16 and/or 18 as earlier described relative to adhesive portions or adhesive strips 28. The opposite surface of item attachments preferably engage an item 26 to be framed following separation of the protective film. Opposite surface of item attachments preferably permit separation of frame members 12, 14, 16 and/or 18 from item 26, to permit repositioning of item 26 relative to frame 10. Alternatively, item 26 may be removed and replaced with another item 26, or item 26 may be engaged to another frame 10 having different aesthetic features and/or qualities.

In some alternative embodiments, the back 24 of frame members 12, 14, 16 and/or 18 include markings 50 which may be etchings, grooves, or surface markings to facilitate the positioning of an item 26 relative to frame members 12, 14, 16 and/or 18 during assembly of the frame 10 and the display of item 26.

In one alternative embodiment, an individual may open a container (elongate cylindrical tube or elongate package) transporting unassembled frame members 12, 14, 16 and 18, as well as adhesive portions or adhesive strips 28 and optional item attachments. An individual may remove the first removable film 110 from the first surface 102 of one or more adhesive portions or adhesive strips 28 for affixation to the back 24 of for example frame member 16. At least one adhesive portion or adhesive strip 28 is used for every four inches of length of frame member 16.

An individual may measure and/or use a level prior to the removal of the second removable film 112 from the opposite surface 104 of adhesive portions or adhesive strips 28. The individual may then press the back 24 of frame member 26 having the exposed opposite surface 104 vertically onto a wall surface 30.

An individual may then place adhesive portion or adhesive strip 28 onto the back 24 of frame members 14 as earlier described. The second removable film 112 for the opposite surface 104 of adhesive portion or adhesive strip 28 may then be removed from frame member 14 and the fifth side 40 and the fourth side 38 may be aligned for positioning and contact with each other, whereon frame member 14 may be pressed horizontally onto a wall surface 30.

An item 26 may then be positioned behind frame member 16 and frame member 14 and aligned relative thereto. The individual may then repeat the attachment procedures described above for frame members 18 and 12 to completely frame item 26 on a wall surface 30.

Alternatively, an individual may attach adhesive portion or adhesive strips 28 to frame member 12, 14, 16 and 18 as described above. The individual may then use markings 50 in order to align item 26 to the back 24 of frame members 12, 14, 16 and 18. An individual may then use optional item attachments to releasably engage item 26 to the back 24 of frame members 12, 14, 16 and 18. The individual may then remove the second removable film 112 from the opposite surface 104 of adhesive portions or adhesive strips 28, and press frame members 12, 14, 16 and 18 onto a wall surface 30 in order to display item 26.

In at least one alternative embodiment, sides 20, 22, 36, 38, 40, 42, 44 and 46 on back 24 of frame members 12, 14, 16 and 18 may include shaped cavities or key cavities 52. In some embodiments when first side 20 is proximate to eighth side 46, seventh side 44 is proximate to third side 36, fourth side 38 is proximate to fifth side 40, and sixth side 42 is proximate to second side 22. The combined shape of the cavities 52 may resemble an hourglass, dog bone, butterfly, two triangles connected by a central structure, two rectangles or squares connected by a central structure, or by any other combined shape as desired by an individual.

In at least one alternative embodiment, shaped cavities 52 include an interior 54 and an outer cavity wall 56. In at least one embodiment, shaped cavities 52 are cut into the back 24 of frame members 12, 14, 16 and 18.

In at least one alternative embodiment, each of the backs 24 of frame members 12, 14, 16 and 18 include one or more elongate cavities 58. In some embodiments, elongate cavities 58 are centrally disposed relative to the backs 24 of frame members 12, 14, 16 and 18, approximately equal distances between the respective sides. Elongate cavities 58 may be cut into the backs 24 of frame members 12, 14, 16 and 18.

In at least one alternative embodiment, the width dimension selected for the frame members 12, 14, 16 and/or 18 may vary between ½ inch and 5 inches. In embodiments where the width dimension of frame members 12, 14, 16 and 18 is selected to exceed 2½ inches, then two or more shaped cavities 52 may be required to be included within each pair of sides forming a corner of frame 10. In some embodiments, the aligned pairs of shaped cavities 52 are also parallel to each other. It should be noted that the width dimension selected for frame members 12, 14, 16 and 18 may be less than ½ inch and greater than 5 inches at the preference of an individual, and dependent upon the item 26 to be displayed within the frame 10.

In some alternative embodiments, a connector 60 which may be shaped like a butterfly is inserted into each of the shaped cavities 52. The contour of the connector 60 preferably matches the shape of the cavities 52 and is slightly smaller than the cavities 52, so that the outer surface 62 of each connector 60 is disposed proximate and adjacent to the outer cavity wall 56 of the shaped cavities 52.

In some alternative embodiments, each connector 60 includes a central bridge 64 and an expandable first end 66, as well as an expandable second end 68. The first end 66 and the second end 68 in some embodiments may include one or more openings 70. In addition, the first end 66 as well as the second end 68 includes an expansion cavity 72 positioned between the openings 70.

In some alternative embodiments, the connectors 60 are used as a low-profile engagement member to assist in the securing of a side of one frame member to an adjacent side of a second frame member.

As shown in FIG. 6 through FIG. 9, in some embodiments, a connector insert 74 is coupled with a connector 60. The connector insert 74 functions to enlarge the expansion cavity 72 as well as the openings 70. During enlargement of the expansion cavity 72 and the openings 70, the outer surface 62 of the expandable first and second ends 66, 68, become frictionally engaged to the outer cavity wall 56 of the shaped cavities 52. The connector insert 74 facilitates the secure engagement of the respective sides of adjacent frame members together during the assembly of frame 10.

The connector insert 74 may be of any desired shape and size, and in some embodiments may be bow tie shaped. In some embodiments, the connector insert 74 has a top outer surface 76 and a bottom surface 78. In some embodiments, the bottom surface 78 includes a plurality of expansion posts 80. The number of expansion posts 80 on the bottom surface 78 preferably equals the number of openings 70 of the expandable first and second ends 66, 68.

In at least one alternative embodiment, each expandable posts 80 is positioned for insertion into one opening 70. The insertion of the expandable posts 80 into openings 70 causes the openings 70 to enlarge, and the expansion cavity 72 to increase in dimension, moving the outer surface 62 of the expandable first and second ends 66 and 68 into pressure friction contact with the outer cavity wall 56 of the shaped cavities 52. The properly positioned frame members 12, 14, 16 and 18 through this procedure may be assembled/affixed together into frame 10.

In at least one alternative embodiment, connector insert 74 includes an extender 82, which extends outwardly relative to connector insert 74. The extender 82 may also be arcuate in shape extending outwardly and downwardly away from an exterior edge of the top surface 76 towards the bottom of expansion posts 80. The distal end of extender 82 preferably includes a normally extending tab 84.

In some alternative embodiments, the extender 82 and tab 84 are disposed towards the interior of the frame 10 and function to secure the mat 32, glass 34, backing 98 and/or image 26 to the back 24 of frame members 12, 14, 16 and 18.

As shown in FIG. 2 through FIG. 5, in at least one embodiment, a cavity connector 86 is disposed within each of the elongate cavities 58. Each cavity connector 86 includes a base 88 having one or more apertures 90. Apertures 90 may function as locations for attachment of a suspension member 114, which may be a wire, which in turn may be used to suspend frame 10 relative to a wall 30.

Each cavity connector 86 preferably includes an upper surface 92. Cavity connector 86 in addition includes a pair of extenders 82. Extenders 82 may be arcuate in shape extending outwardly and downwardly away from an exterior edge of the upper surface 92 towards the bottom of the base 88. The distal ends of the extenders 82 may be engaged together by a normally extending cross tab 94. Cross tab 94 is disposed towards the interior of the frame 10 and functions to assist in securing of the mat 32, glass 34, backing 98 and/or image 26 to the back 24 of frame members 12, 14, 16 and 18. It should be noted that connector inserts 74 as well as cavity connectors 86 are positioned so that extenders 82 are disposed inwardly towards the interior of frame 10. The shape and elasticity of the extenders 82 creates pressure on the item 26, pane 34, mat 32 and backer 98 to hold the item 26, pane 34, mat 32 and backer 98 within frame 10. The shape and elasticity of the extenders 82 permits the item 26, pane 34, mat 32 and backer 98 to each have a variety of thickness dimensions. The extenders 82 engage and secure the item 26, pane 34, mat 32 and backer 98 to the frame when the combined thickness of the item 26, pane 34, mat 32 and backer 98 has a small, medium or large dimension.

In some alternative embodiments, the base 88 of cavity connectors 86 include a plurality of friction connectors 96. Friction connectors 96 may be used to secure cavity connectors 86 within, and to the bottom of the elongate cavities 58.

In at least one alternative embodiment, one or a plurality of magnets may be secured to the back 24 of frame members 12, 14, 16 and/or 18. Magnets may be used to releasably secure frame 10 to a metallic surface.

In at least one alternative embodiment, one or more of the contact locations between the extenders 82 of the cavity connectors 86 may include a living hinge. Living hinge preferably enables the movement of a backer board or backing 98 away from the frame 10 to function as a stand or easel 116 for the frame 10, when the frame 10 is vertically set upon a horizontal surface.

It should be noted that any desired number of cavity connectors 86 may be used along the back 24 of frame members 16 and 18 to releasably secure an item 26 and frame 10 to a wall 30. It should also be noted that each of the extenders 82 used on a cavity connector 86, or connector insert 74, are resiliently flexible and accommodate varying thicknesses of item 26, mat 32, glass 34 and/or backer board or backing 98.

In some alternative embodiments, the assembled frame 10 may have dimensions larger or smaller than eight inches by ten inches (hereinafter referred to as 8"×10"), 12"×12", 18"×24" and/or 16"×20" to name a few of the possible sizes for the frame 10. In some embodiments, the thickness of an item 26 may be larger or smaller than a range of 0.0393701 inches to 1.75 inches.

In some alternative embodiments the elements of the frame 10 including the frame members 12, 14, 16 and 18 as well as the connectors 60, connector insert 74, cavity connectors 86, adhesive portions or adhesive strips 28 and item attachments are packaged, shipped and displayed for purchase in an unassembled first configuration. An individual may quickly and easily assemble the frame 10 as described herein into an assembled second configuration without the use of tools or other equipment, and without damage to a wall or structure as a result of elimination of the need to penetrate a wall or structure with a hanger, nail, screw or other item to name a few.

In some alternative embodiments, connector 60, connector insert 74 as well as cavity connectors 86 are formed of flexible materials, which in some embodiments may be metal, plastic or composite materials. The material selected for the connectors 60, connector inserts 74 as well as the cavity connectors 86 are preferably resiliently flexible and expandable to ensure proper function as described herein.

Figure 6:
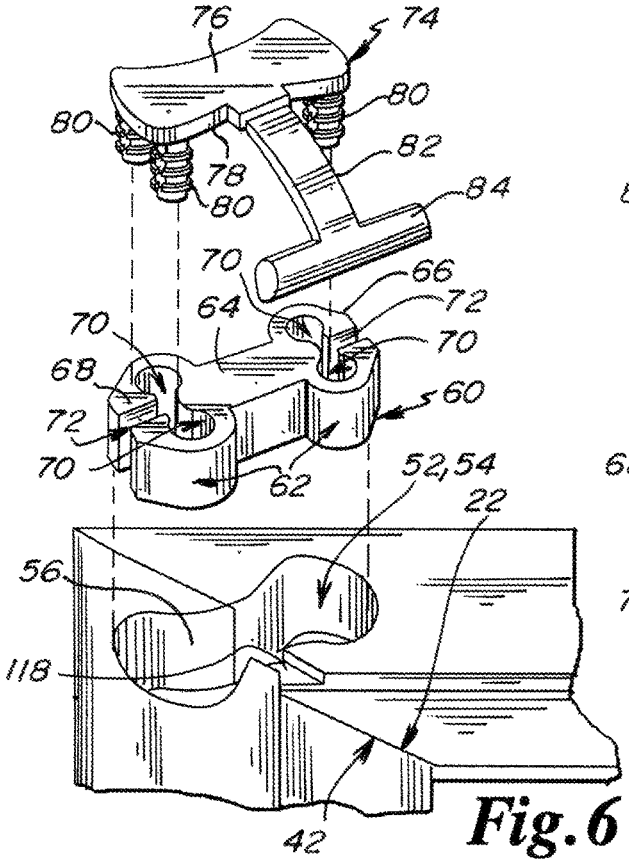
FIG. 6 is a detail isometric exploded view of one embodiment of a shaped cavity, connector and connector insert used in one embodiment of the invention.
Figure 7:
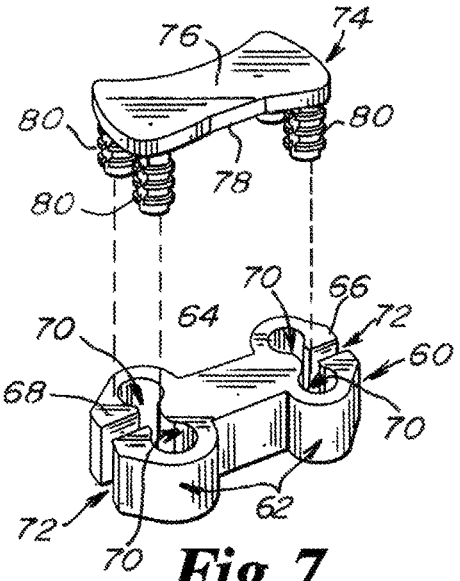
FIG. 7 is an alternative detail isometric exploded view of one embodiment of a connector and connector insert used in one embodiment of the invention.
Figure 8:
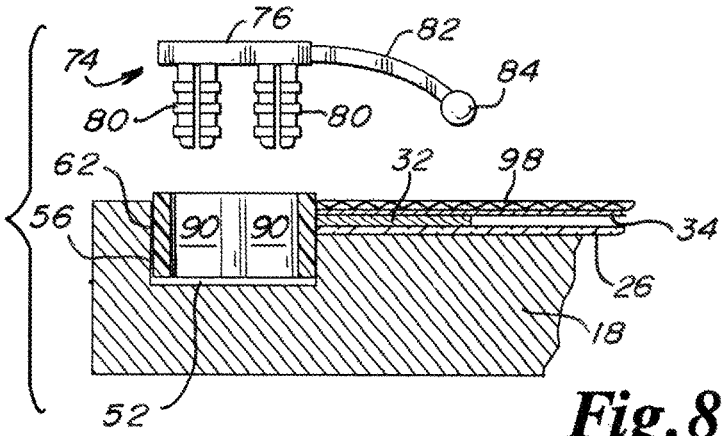
FIG. 8 is a detail partial cross-sectional side view taken along the line 8-8 of FIG. 5 showing one embodiment of a shaped cavity and connector inserted into the shaped cavity, and connector insert prior to insertion into the connector, as used in one embodiment of the invention.
Figure 9:
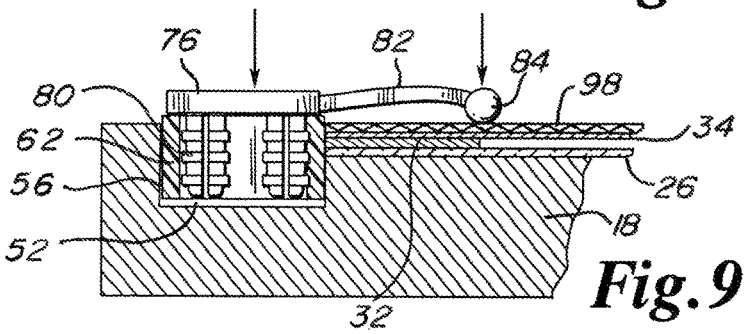
FIG. 9 is a detail partial cross-sectional side view taken along the line 8-8 of FIG. 5 showing one embodiment of a shaped cavity and connector and connector insert as inserted into the shaped cavity as used in one embodiment of the invention.

In some alternative embodiments as shown in FIG. 6, a channel 118 is positioned to the interior of one or more of the shaped cavities 52 or elongate cavities 58. The channel(s) 118 functions to provide a space having a dimension which is slightly larger than the width of extender 82 so that extender 82 may pass downwardly between the shaped cavity 52 and a frame rabbit to facilitate the functionality and elasticity of the extenders 82 to create pressure on the item 26, pane 34, mat 32 and/or and backer 98 to hold the item 26, pane 34, mat 32 and/or backer 98 within frame 10.

In some alternative embodiments as shown in FIGS. 12 through 15 a backer 98 may be used with the frame members 12, 14, 16 and 18 to position the frame 10 substantially vertically upon a horizontal surface.

Figure 12:
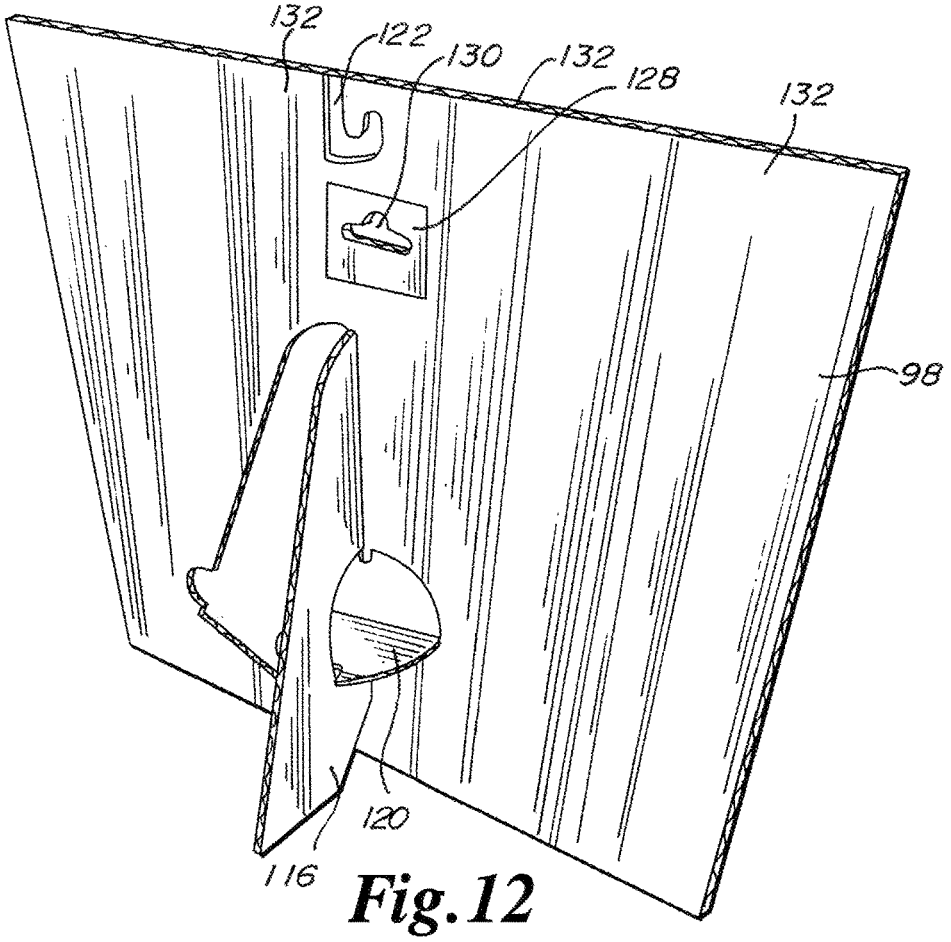
FIG. 12 is an isometric rear view of one embodiment of a backer used in one embodiment of the invention.
Figure 13:
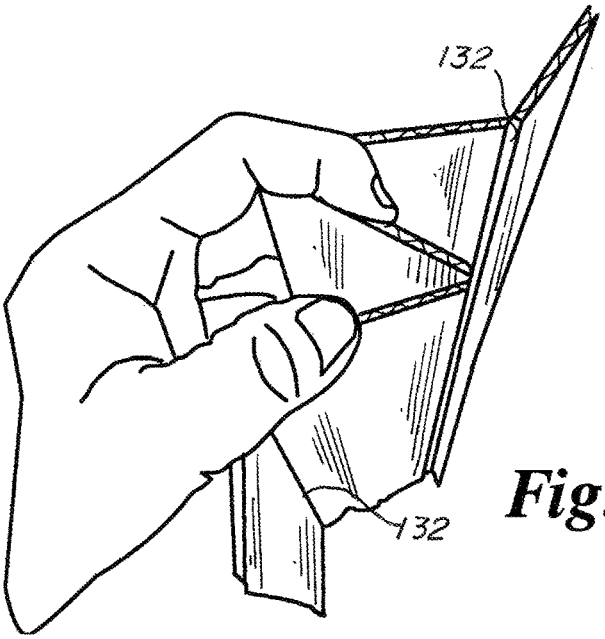
FIG. 13 is a detail top perspective view of one embodiment of a backer in a folded configuration prior to use in one embodiment of the invention.
Figure 15:
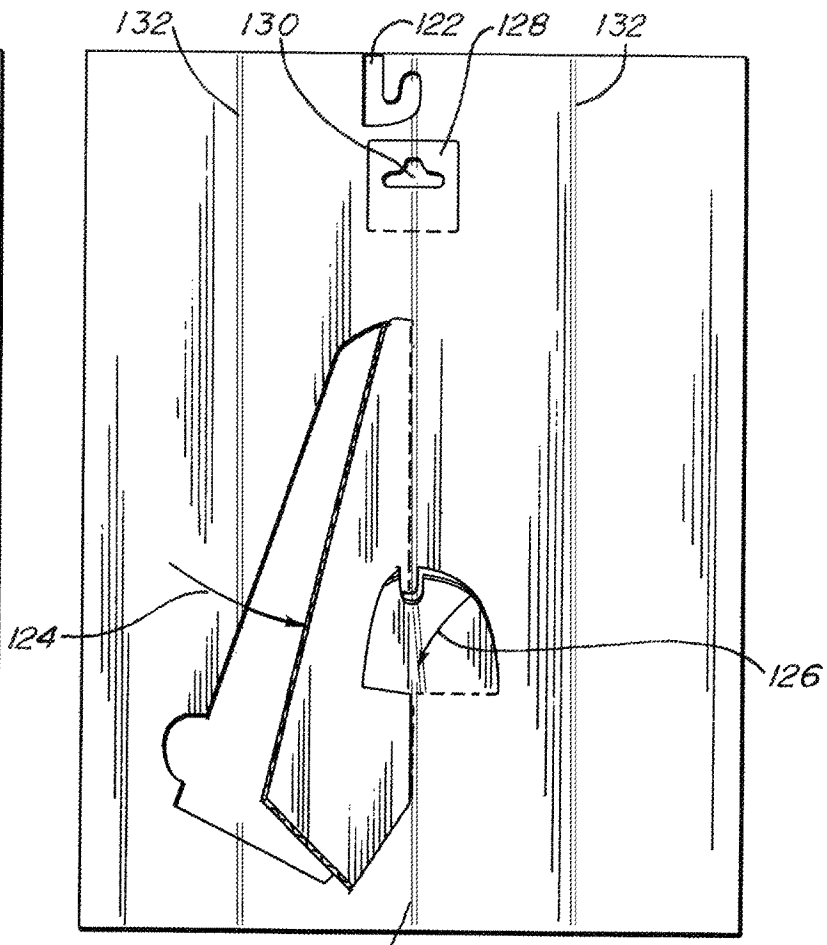
FIG. 15 is a rear view of one embodiment of the backer during the manipulation of the pop-out easel into an operative position.
Figure 14:
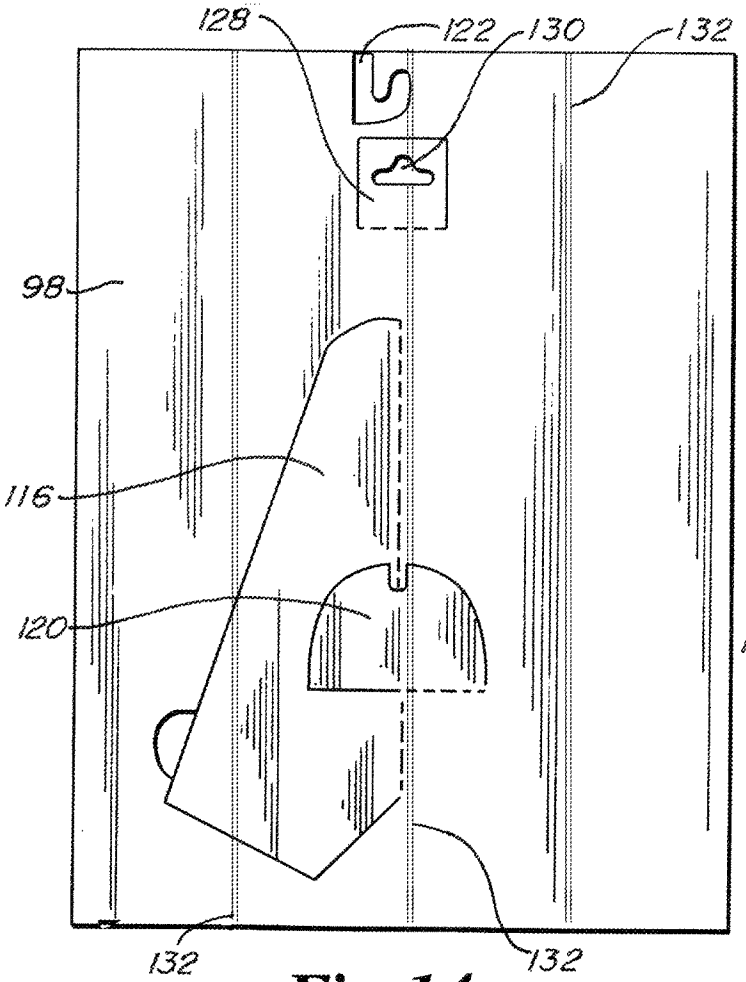
FIG. 14 is a rear view of one embodiment of a backer of the invention prior to the manipulation of the pop-out easel into an operative position.

In some alternative embodiments, the backer 98 includes a foldout or pop-out easel 116, an easel support 120, a groove 122 and a hanging tab 128. The easel 116 may be folded rearwardly and outwardly away from the backer 98 as depicted by arrow 124 to provide the structure for the frame 10 to be positioned substantially vertically relative to a horizontal surface. The easel support 120 following the manipulation of the easel 116 in direction of arrow 124 may be rotated downwardly in the direction of arrow 126 to secure the easel 116 in an operative position as depicted in FIG. 12.

Is should be noted that the backer 98 includes a vertical hinge edge for the easel 116 and a horizontal hinge edge for the easel support 120 to facilitate folding into an operative position. The backer 98 having the pop-out easel 116 and easel support 120 may be manipulated from a flat pre-operative position to an operative position allowing the frame to lean on the lower surface of the easel 116, and to allow for a freestanding display.

In some alternative embodiments, the backer 98 also includes a groove 122, which may function as a structure for hanging of the frame 10. In addition, the backer 98 may also include a hanging tab 128, which may include a hanging opening 130. The hanging tab 128 may be folded outwardly along a horizontal hinge away from backer 98. The hanging tab 128 may be used engage the backer 98 and frame 10 to a structure which is secured to a wall 30 for the hanging of the frame 10 relative to the wall 30.

As may be seen in FIGS. 12-15 the backer may include a plurality of vertically extending folding hinges 132. The folding hinges 132 permit the backer 98 to be folded into a desired (zigzag) compact configuration for shipping or display. During use the backer 98 may be unfolded along the folding hinges 132 and manipulated into an operative configuration for use with the frame 10. It should be noted that following the manipulation of the backer 98 into an operative configuration the backer 98 adds stiffness and structure to the frame 10 for hanging or for free standing display. Alternatively, the backer 98 may be vertically scored or cut at desired locations to permit the backer 98 to be stored in an accordion-type fashion, whereupon the backer 98 may regain stiffness properties when flattened and/or connected to the frame members 12, 14, 16 and 18.

In some alternative embodiments, a tool may be used to create shaped cavities 52 and elongate cavities 58 in the back or rear side of stock frame materials. In this embodiment following the creation of a desired number of shaped cavities 52 and elongate cavities 58 into the stock material, an individual may obtain the elements of the adhesive or adhesive strips 28, connectors 60, connector inserts 74 and cavity connectors 86 for use as previously described for the hanging or display of a frame 10 as formed of stock materials. In addition, a backer 98 and pane 34 of glass or other material may be used with stock frame members 12, 14, 16 and 18, which have received the shaped cavities 52 and elongate cavities 58.

In at least one alternative embodiment, the stiff backer 98 may have adhesive on at least one side and may be adhered to a print/art/image 26 to provide a display with or without the use of a frame 10, and with or without the backer 98 being folded into an accordion-type configuration, where the backer 98 may be mailed through traditional shipping methods.

Figure 16:
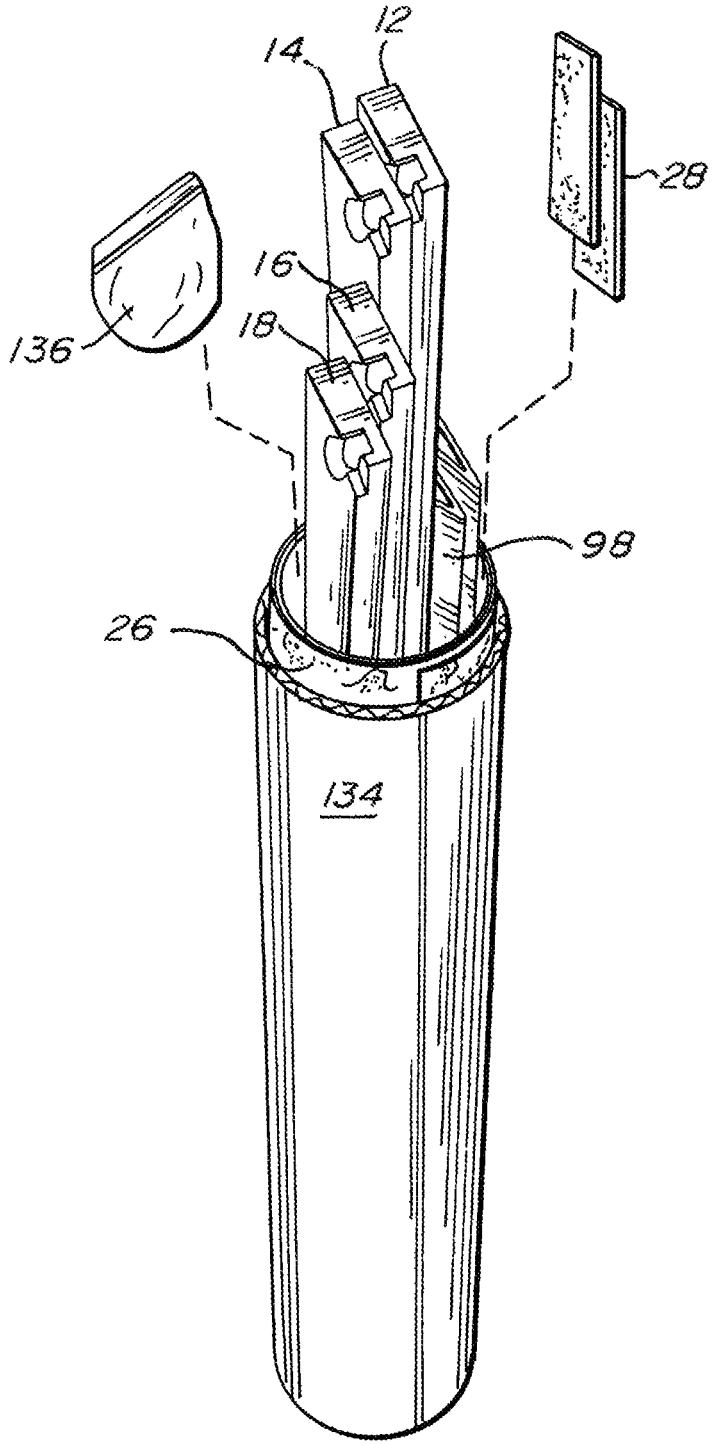
FIG. 16 is an isometric view of a shipping container, components of the Quick Assembly Photo Frame and item as used in one embodiment of the invention.

As may be seen in FIG. 16 in one alternative embodiment, the components of the frame 10 in an unassembled configuration may be nested together for placement within a cylindrical carrier or tube 134. A backer 98, frame members 12, 14, 16, 18 and adhesive portions 28 may also be placed within the carrier or tube 134 for shipping or display at a retail location to conserve storage and/or display space, thereby minimizing overhead expense. In addition, an item 26 may be rolled into a cylindrical configuration, and placed within the container 134 for sale in conjunction with the components of the quick assembly photo frame 10. In one alternative embodiment, the elements of the connectors 60, connector inserts 74, cavity connectors 86 and/or suspension member 114, in any combination, may be placed into a plastic package 136, and the package 136 may also be included within the interior of the container or tube 134 for display, storage or shipping. In some embodiments the container 134 will have a cap (not shown) to releasably secure the components of the quick assemble photo frame 10 within the container 134.

In a first alternative embodiment a frame for an item is disclosed, the frame having at least two frame members, each of the frame members having a first unassembled state, each of the frame members having a front, a back, a first edge, the first edges having an identical first length dimension, a second edge, the second edges having an identical second length dimension, the second length dimension being less than the first length dimension, each of the first edges being substantially parallel to the second edges, each of the frame members further having a first side and a second side, the first side having a first angle relative to the first edge and the second edge, the second side having a second angle relative to the first edge and the second edge, wherein the first angle and the second angle are supplementary angles; a plurality of adhesive portions or adhesive strips, each of the adhesive portions or adhesive strips having a first unengaged state, each of the adhesive portions or adhesive strips having a first surface and an opposite surface, an attachment adhesive on the first surface, a first removable film on the attachment adhesive, a re-attachable adhesive on the opposite surface, a second removable film on the re-attachable adhesive; wherein the first removable film is constructed and arranged for separation from the attachment adhesive of at least one of the adhesive portions or adhesive strips and the at least one adhesive portion or adhesive strip is constructed and arranged for secure attachment of the first surface to the back of each of the frame members; further wherein the second removable film is constructed and arranged for removal from the re-attachable adhesive of at least one of the adhesive portions or adhesive strips on each of the frame members and the at least one opposite surface is constructed and arranged for pressing onto a wall surface; and further wherein the back, the first side and the first angle of one of the frame members is disposed adjacent to and in contact with the back, the second side and the second angle of another of the frame members on the wall surface in a second assembled state forming the frame; and an item is disposed between the back and the wall surface, wherein each of the frame members is independently removed from the wall surface or the frame in the second assembled state is removed from the wall surface, and the frame members or the frame are repositioned onto the wall surface.

In at least one second alternative embodiment in accordance with the first alternative embodiment, each of the backs of the frame members comprise at least one marking, the at least one marking being constructed and arranged for alignment of the item relative to the frame.

In at least one third alternative embodiment a frame for an item is disclosed, the frame having a plurality of frame members, each of the frame members having a first unassembled state, each of the frame members having a front, a back, a first edge, the first edges having an identical first length dimension, a second edge, the second edges having an identical second length dimension, the second length dimension being less than the first length dimension, each of the first edges being substantially parallel to the second edges, each of the frame members further having a first side and a second side, the first side having a first angle relative to the first edge and the second edge, the second side having a second angle relative to the first edge and the second edge, wherein the first angle and the second angle are supplementary angles, wherein the back, the first side and the first angle of one of the frame members is disposed adjacent to and in contact with the back, the second side and the second angle of another of the frame members in a second assembled state forming the frame, each of the first sides and each of the second sides having a having a cavity, wherein alignment of the cavities of the first sides to the cavities of the second sides forms a shaped cavity, the shaped cavities defining an outer cavity wall; a plurality of connectors, one of the connectors being disposed in each of the shaped cavities, each of the connectors comprising an expandable first end having at least one first opening and an expandable second end having at least one second opening, each of the connectors having an exterior surface; and a plurality of connector inserts, one of the connector inserts being constructed and arranged for insertion into one of the connectors, the connector inserts comprising expansion posts, wherein the expansion posts are constructed and arranged for insertion into the at least one first opening and the at least one second opening expanding the exterior surface into contact with the outer cavity wall.

In at least one fourth alternative embodiment in accordance with the third alternative embodiment the backs of each of the frame members has at least one elongate cavity.

In at least one fifth alternative embodiment according to the fourth alternative embodiment, the frame further comprises a plurality of cavity connectors, wherein one of the cavity connectors is disposed in each of the elongate cavities.

In at least one sixth alternative embodiment according to the fifth alternative embodiment, each of the connectors further comprises an expansion cavity proximate to the at least one first opening and the at least one second opening.

In at least one seventh alternative embodiment according to the sixth alternative embodiment, each of the connector inserts and/or cavity connectors further comprise at extender having a distal end having a tab, the extender and the tab being constructed and arranged to hold an item proximate to the back of the frame members in the second assembled state.

In at least one eighth alternative embodiment according to the seventh alternative embodiment, each of the cavity connectors comprise a base having at least one aperture and at least one cross tab.

In at least one ninth alternative embodiment according to the eighth alternative embodiment, the cross tab engages the item holding the item proximate to the back of the frame members in the second assembled state.

In at least one tenth alternative embodiment according to the sixth alternative embodiment, one of the apertures on one of the cavity connectors on one of the frame members and one of the apertures on one of the cavity connectors on one of the frame members opposite to the one of the frame members, is constructed and arranged to receive a suspension member, the suspension member being engaged to the wall surface and hanging the frame from the wall surface.

In at least one eleventh alternative embodiment according to the tenth alternative embodiment, the base of each of the cavity connectors has friction connectors, the friction connectors releasably engaging one of the elongate cavities.

In at least one twelfth alternative embodiment according to the fifth alternative embodiment, the frame further comprises a plurality of adhesive portions or adhesive strips, each of the adhesive portions or adhesive strips having a first unengaged state, each of the adhesive portions or adhesive strips having a first surface and an opposite surface, the first surface having an attachment adhesive and a first removable film on the attachment adhesive, the opposite surface having a re-attachable adhesive and a second removable film on the re-attachable adhesive.

In at least one thirteenth alternative embodiment according to the twelfth alternative embodiment, the first removable film is constructed and arranged for separation from the attachment adhesive of at least one of the adhesive portions or adhesive strips and the at least one adhesive portion or adhesive strip is constructed and arranged for secure affixation of the attachment adhesive to the back of each of the frame members.

In at least one fourteenth alternative embodiment according to the thirteenth alternative embodiment the second removable film is constructed and arranged for removal from the re-attachable adhesive on each of the frame members, and the re-attachable adhesive is constructed and arranged for pressing onto a wall surface.

In at least one fifteenth alternative embodiment according to the fourteenth alternative embodiment, an item is disposed between the frame and the wall surface, and each of the frame members is independently removable from the wall surface, or the frame in said second assembled state is removable from the wall surface, and the frame members or the frame may be repositioned onto the wall surface at a different location.

In at least one sixteenth alternative embodiment according to the fifteenth alternative embodiment, each of the backs of the frame members comprise at least one marking, the at least one marking being constructed and arranged for alignment of the item relative to the frame.

This completes the description of the preferred and alternate embodiments of the invention. Those skilled in the art may recognize other equivalents to the specific embodiment described herein which equivalents are intended to be encompassed by the claims attached hereto.

The above disclosure is intended to be illustrative and not exhaustive. This description will suggest many variations and alternatives to one of ordinary skill in this art. The various elements shown in the individual figures and described above may be combined or modified as desired. All these alternatives and variations are intended to be included within the scope of the claims where the term "comprising" means "including, but not limited to".

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

I claim:

1. A frame for an item, said frame comprising:

a plurality of frame members, each of said frame members having a first unassembled state, each of said frame members having a front, a back, a first edge, said first edge having a first length dimension, a second edge, said second edge having a second length dimension, said second length dimension being less than said first length dimension, each of said first edges being substantially parallel to said second edges, each of said frame members further having a first side and a second side, said first side having a first angle relative to said first edge and said second edge, said second side having a second angle relative to said first edge and said second edge, wherein said first angle and said second angle are supplementary angles;

wherein said back, said first side and said first angle of one of said frame members is disposed adjacent to and in contact with said back, said second side and said second angle of another of said frame members in a second assembled state forming said frame;

each of said first sides and each of said second sides having a cavity, wherein alignment of said cavities of said first sides to said cavities of said second sides forms a shaped cavity, said shaped cavity defining an outer cavity wall;

a plurality of connectors, one of said connectors being disposed in each of said shaped cavities, each of said connectors comprising an expandable first end having at least one first opening and an expandable second end having at least one second opening, each of said connectors having an exterior surface; and a plurality of connector inserts, one of said connector inserts being constructed and arranged for insertion into one of said connectors, said connector inserts comprising expansion posts, wherein said expansion posts are constructed and arranged for insertion into said at least one first opening and said at least one second opening expanding said exterior surface into contact with said outer cavity wall.

2. The frame according to claim 1, said backs of each of said frame members having at least one elongate cavity.

3. The frame according to claim 2, further comprising a plurality of cavity connectors, wherein one of said cavity connectors is disposed in each of said elongate cavities.

4. The frame according to claim 3, each of said connectors further comprising an expansion cavity proximate to said at least one first opening and said at least one second opening.

5. The frame according to claim 4, each of said connector inserts further comprising at least one extender having a distal end having a tab, said at least one extender and said tab being constructed and arranged to hold an item proximate to said back of said frame members in said second assembled state.

6. The frame according to claim 5, each of cavity connectors comprising a base having at least one aperture and at least one cross tab.

7. The frame according to claim 6, wherein said cross tab engages said item holding said item proximate to said back of said frame members in said second assembled state.

8. The frame according to claim 7, wherein one of said apertures on one of said cavity connectors on one of said frame members and one of said apertures on one of said cavity connectors on one of said frame members opposite to said one of said frame members is constructed and arranged to receive a suspension member, said suspension member being engaged to said wall surface and hanging said frame from said wall surface.

9. The frame according to claim 8, wherein said base of each of said cavity connectors has friction connectors, said friction connectors releasably engaging one of said elongate cavities.

10. The frame according to claim 3, said frame further comprising a plurality of adhesive portions, each of said adhesive portions having a first unengaged state, each of said adhesive portions having a first surface, an opposite surface, an attachment adhesive on said first surface and a first removable film on said attachment adhesive, said opposite surface having a re-attachable adhesive and a second removable film on said re-attachable adhesive.

11. The frame according to claim 10, wherein said first removable film is constructed and arranged for separation from said attachment adhesive of at least one of said adhesive portions and said attachment adhesive is constructed and arranged for secure engagement to said back of each of said frame members.

12. The frame according to claim 11, wherein said second removable film is constructed and arranged for removal from said re-attachable adhesive on each of said frame members, and said re-attachable adhesive is constructed and arranged for pressing onto a wall surface.

13. The frame according to claim 12, wherein an item is disposed between said frame and said wall surface, and each of said frame members is independently removable from said wall surface, or said frame in said second assembled state is removable from said wall surface, and said frame members or said frame are repositionable onto said wall surface.

14. The frame according to claim 13, each of said backs of said frame members comprising at least one marking, said at least one marking being constructed and arranged for alignment of said item relative to said frame.

* * * * *